US006967584B2

(12) United States Patent
Maki

(10) Patent No.: US 6,967,584 B2
(45) Date of Patent: Nov. 22, 2005

(54) INTEGRATED SENSOR CABLE FOR RANGING

(75) Inventor: Melvin C. Maki, Kanata (CA)

(73) Assignee: Senstar-Stellar Corporation, Carp (CA)

( * ) Notice: Subject to any disclaimer, the term of this patent is extended or adjusted under 35 U.S.C. 154(b) by 215 days.

(21) Appl. No.: 10/627,618

(22) Filed: Jul. 28, 2003

(65) Prior Publication Data

US 2005/0024210 A1 Feb. 3, 2005

(51) Int. Cl.[7] ..... G08B 21/00

(52) U.S. Cl. ..... 340/657; 340/564; 340/552; 340/566; 321/525; 321/532

(58) Field of Search ..... 340/564, 552, 340/554, 501, 566; 324/525, 532–535

(56) References Cited

U.S. PATENT DOCUMENTS

| | | | | |
|---|---|---|---|---|
| 2,787,784 A | | 4/1957 | Meryman | |
| 3,316,620 A | | 5/1967 | Stewart | |
| 3,707,709 A | | 12/1972 | Wolf et al. | |
| 3,750,127 A | | 7/1973 | Ayers et al. | |
| 3,763,482 A | | 10/1973 | Burney | |
| 3,846,780 A | | 11/1974 | Gilcher | |
| 4,047,166 A | | 9/1977 | Miller et al. | |
| 4,155,083 A | | 5/1979 | Slaats et al. | |
| 4,197,529 A | | 4/1980 | Ramstedt et al. | |
| 4,598,168 A | * | 7/1986 | Wagner et al. | 174/115 |
| 5,268,672 A | | 12/1993 | Kerr | |
| 5,446,446 A | | 8/1995 | Harman | |
| 5,448,222 A | | 9/1995 | Harman | |
| 5,473,336 A | * | 12/1995 | Harman et al. | 343/790 |
| 5,705,984 A | | 1/1998 | Wilson | |
| 6,577,236 B2 | | 6/2003 | Harman | |
| 2002/0041232 A1 | | 4/2002 | Harman | |
| 2004/0114888 A1 | * | 6/2004 | Rich et al. | 385/101 |

OTHER PUBLICATIONS

Dielectric Absorption Blocks versus Electret Blocks, URL; http://www.fortunecity.com/greenfield/bp/16/electrets.htm.
Electrostatics And Its Applications, Electrical and Computer Engineering Department, University of Michigan, Ann Arbor, A Wiley–Interscience Publication, 1973.
URL: Ryne C. Allen, Triboelectric Generation: Getting Charged, Desco Industries, Inc. (DII), Employee Owned, Dec. 2000. http://www.esdsystems.com.

* cited by examiner

*Primary Examiner*—Daniel Wu
*Assistant Examiner*—Samuel J. Walk

(57) ABSTRACT

An intrusion detection system provides the function of an "active" ranging sensor cable system utilized for identification of the location of the intruder, with that of a "passive" cable detection system, in an integrated cable configuration. This dual function is provided with a single conventional sensing cable optimized for both "active" and "passive" sensing, or in combination with other parallel sensing cables for a "passive" cable component. The "active" cable component includes a coaxial sensor cable having a loosely disposed conductor. A signal is injected into the sensor cable such that a reflection is altered when an intrusion disturbs the cable. Based on the timing of the reflection, a processor, or a reflectometer, identifies the location of the disturbance. The "passive" cable component can be sensitized to detect intrusion via some other sensing phenomenology, such as the triboelectric effect, for triboelectric effect sensing.

32 Claims, 5 Drawing Sheets

INTEGRATED SENSOR CABLE FOR RANGING

BACKGROUND OF THE INVENTION

1. Field of the Invention

The present invention relates to a perimeter intrusion detection system with integrated sensor cable. More particularly, the present invention relates to a security sensor system, with a specific cable configuration, for locating a disturbance along the length of the sensor cable and for providing intrusion data through a further use of the sensor cable.

2. Description of the Prior Art

In the field of outdoor intrusion detection systems, there are many security systems for sensing disturbances along a distributed sensor cable deployed about a perimeter. These systems face certain challenges not found in indoor security situations. Environmental conditions, such as temperature extremes, rain, snow, animals, blowing debris, seismic effects, terrain and traffic, must all be taken into account. When functioning under these adverse conditions, the system must continue to maintain a high probability of detection while minimizing false alarms (alarms with unknown causes) and nuisance alarms (environment-related alarms), both of which may compromise and reduce the performance of the security system.

Fence and wall-associated sensors are above-ground detection sensors that are attached to an existing fence or wall. They detect intrusion when an intruder disturbs the detection field, or when strain or vibration due to cutting or climbing on a metal fabric fence triggers an alarm. IntelliFIBER™ is a fiber-optic based fence-disturbance sensor for outdoor perimeter security applications from Senstar-Stellar Corp., of Carp, Ontario, Canada. This prior art fiber optic sensor can detect intruders cutting, climbing, or lifting fence fabric, and it provides protection circuitry against electromagnetic interference, radio frequency interference, and lightning. The system includes a programmable microprocessor that processes signals based on the changes in optical parameters generated as a result of disturbances in proximity to the distributed fiber optic sensor cable. The microprocessor allows the user to calibrate and set operating parameters for specific zones/environments. Alarm processing optimizes detection and minimizes nuisance alarms from wind, rain, snow, fog, animals, debris, seismic activity, and the like.

In many security systems, one important characteristic which is useful to determine in conjunction with suitable processing means, is the location of the disturbance along the length of a sensor cable. Such a characteristic is commonly known in the art as "ranging". Ranging is useful both to identify the intruder, but also to locate and rectify locations where nuisance alarms are generated, for example a loose sign banging on the fence.

In any intrusion detection system, the ability to minimize false or nuisance alarms is enhanced when better information on the intrusion event is obtained. Hence, location data, and/or simultaneous data from two or more detection phenomenologies, is useful data to fuse for processing to further obtain either a higher probability of detection, a lower false alarm rate (FAR), a lower nuisance alarm rate (NAR), or a combination.

In the prior art, there are various security systems having a ranging capability. For instance, U.S. Pat. No. 5,446,446, issued to Harman, discloses a transducer cable for detecting the location of a sensed disturbance along the length of the transducer cable. A "driving" signal is imposed on the transducer cable in order to obtain a response signal. According to Harman, the location of the intruder is determined from the detected response signal. While ranging capabilities of a transducer cable are taught by Harman, the specific transducer cable design is costly, and only allows detection by a single means, namely an impedance change. In another related U.S. Pat. No. 5,448,222, a single means is also disclosed.

Another Harman published patent application, US 2002/00441232, discloses a cable guided radar system for the detection and location of an intruder. The cable system comprises a pair of leaky coaxial cables coupled to an RF transceiver which is in turn coupled to a processor. However, the dual leaky coaxial cable structure is very expensive to produce, requires the generation and reception of an external electromagnetic field, and provides only a single detection signal caused by the motion of a target in the field. Additionally, sensing a target within an external field has not been found to be a practical application for mounting on metal structures, such as fences, nor typically above ground such as on walls.

The U.S. Pat. No. 5,705,984, issued to Wilson, discloses a sensing system with a deformable sensor cable utilizing a reflectometer to measure the reflected signal. The deformable sensor cable of the Wilson patent discloses a ranging capability where an RF signal is injected along the sensor cable and the reflected signal measured. However, a deformable cable requires that the cable be compressed to detect an intrusion rather than sensing movement of the conductor. In the U.S. Pat. No. 3,846,780, issued to Gilcher, while a loose centre conductor in tube is disclosed, a sensor cable system with a ranging capability is not provided. Neither reference discloses a dual use sensor cable for ranging and for processing of detection data, as well as a suitable cable configuration for such dual purposes.

In view of the above-noted shortcomings, the present invention seeks to provide an intrusion detection system (IDS) with an integrated sensor cable having a multipurpose application to provide additional intrusion data in a security sensor system. In addition, the present invention seeks to provide a sensor cable utilized for ranging purposes in combination with at least one parallel passive or active sensor cable utilized for intrusion detection purposes, to form an integrated sensor cable.

SUMMARY OF THE INVENTION

The present invention provides an intrusion detection system (IDS) which provides the function of an "active" ranging sensor cable system utilized for identification of the location of the intruder, with that of a known "active or passive" cable detection system, in an integrated cable configuration. This dual function is provided in conjunction either with a single conventional sensing cable applied in a novel manner, or in combination with other parallel sensing cables to form a functionally integrated sensor cable. The integrated sensor cable is coupled to an IDS processor and utilized by the IDS to achieve a dual functionality. In terms of the first function, an "active" ranging cable component includes a shielded coaxial sensor cable having a loosely disposed conductor. A signal pulse is injected into one end of this cable. When an intrusion disturbs the sensor cable, and hence alters its capacitance, or impedance at the intrusion location, the reflection of the signal pulse will be altered. A measurement of the reflection at the same cable end by a receiver and processor provides timing information relative to the pulse injected. Hence, the processor identifies the location of the disturbance based on the return time of the reflection along the sensor cable. Such a time-based sensing of cable impedance changes versus distance is conventionally performed by a Time Domain Reflectometer (TDR) function.

Regarding the second function, the single conventional sensing cable or an additional parallel cable, also in combination with the processor is used to sense intrusion disturbances, by another sensing phenomenology, in order to provide additional intrusion data. For a passive use of the functionally integrated sensor cable using a single conventional sensing cable, the conventional sensing cable must be constructed to generate a terminal voltage in response to an intrusion disturbance. The processor then generates a signal in response to the voltage produced by the conventional sensing cable.

The overall processing means monitors the reflection of the signal pulses from the ranging cable component, and also the passively sensed signal either received from the single cable or the parallel sensor cable. The signals generated by the processing means provide intrusion location and other characteristics in order to detect and classify the intrusion. The detection and classification of intrusions by combining data from multiple sensors is commonly termed in the art, sensor fusion.

For further clarity, the additional parallel cable is not necessary to provide the dual sensing function of the present invention. If the coaxial cable having a loosely disposed conductor is sensitized to detect via some other sensing phenomenology such as the triboelectric effect, the same cable can then be used both actively for range information and passively for triboelectric effect sensing. Such is the case when used in conjunction with the sensor cable of the proprietary Intelli-FLEX™ system of Senstar-Stellar Corp. Cables with one or more loose conductors from other manufacturers, and using other sensing phenomenologies could potentially be utilized or adapted for the dual function. Other such sensing phenomenologies could include magnetic, piezoelectric, electret, and the like, and may be utilized without straying from the intended scope of the present invention.

The present invention is also advantageous in that the sensor cable system may be further integrated with other parallel components to provide intrusion information such as ranging in a fence-mounted application to monitor the perimeter of the fence, as well as power distribution and other functionalities in a single sensor cable.

In a first aspect, the present invention provides an intrusion detection system comprising a coaxial cable having a first electrically conductive cable member, a second electrically conductive cable member, and an electrical insulating member disposed between the first cable member and the second cable member, the first cable member being loosely disposed in the coaxial cable and thus freely movable relative to the insulating member to provide an impedance change in response to a disturbance, and the coaxial cable capable of producing a terminal voltage in response to the disturbance, and a processing unit, operatively coupled to the coaxial cable, for propagating an injected signal into the coaxial cable and receiving a reflected signal altered by the impedance change along the coaxial cable, and locating the disturbance based on a timing differential between the reflected signal relative and the injected signal, in an active state, and for generating a signal in response to the terminal voltage produced from the coaxial cable, in a passive state.

In a second aspect, the present invention provides an intrusion detection system comprising an integrated sensor cable having an input and an output, the sensor cable having a primary cable having a first electrically conductive cable member, a second electrically conductive cable member, and an electrical insulating member disposed between the first cable member and the second cable member, the first cable member being loosely disposed in the primary cable and thus freely movable relative to the insulating member, to provide an impedance change in response to a disturbance and at least one secondary sensor cable capable of producing a response to the disturbance, and a processing unit, operatively coupled to the input side and the output side of the integrated sensor cable, for propagating an injected signal and receiving a reflected signal altered by the impedance change along the primary cable, and locating the disturbance based on a timing differential between the reflected signal and the injected signal, in an active state, and for generating a signal based on the response from the at least one secondary sensor cable, in a passive state, wherein the primary cable propagates there along an injected signal from the processing unit.

In a third aspect, the present invention provides an intrusion detection system comprising an integrated sensor cable having an input and an output, the sensor cable having a coaxial cable having a first electrically conductive cable member, a second electrically conductive cable member, and an electrical insulating member disposed between the first cable member and the second cable member, the first cable member being loosely disposed in the coaxial cable and thus freely movable relative to the insulating member, to provide an impedance change in response to a disturbance, and capable of producing a terminal voltage in response to the disturbance; a reflectometer for propagating an injected signal and receiving a reflected signal altered by the impedance change along the coaxial cable, a processor for generating a signal in response to the terminal voltage produced from the coaxial cable and switching means being coupled to the processor and the reflectometer for alternating in a time sequence between the processor and the reflectometer, wherein the switching means is coupled to the input and the output of the integrated sensor cable, and wherein the processor is coupled to the reflectometer for locating the disturbance along the integrated sensor cable based on a timing differential of the reflected signal relative to the injected signal.

In a fourth aspect, the present invention provides an intrusion detection system comprising an integrated sensor cable having an input and an output, the sensor cable having a primary cable having a first electrically conductive cable member, a second electrically conductive cable member, and an electrical insulating member disposed between the first cable member and the second cable member, the first cable member being loosely disposed in the primary cable and thus freely movable relative to the insulating member, to provide an impedance change in response to a disturbance and at least one secondary cable capable of producing a terminal voltage in response to the disturbance; a reflectometer, coupled to the input of the integrated sensor cable, for propagating an injected signal and receiving a reflected signal altered by the impedance change along the primary cable and a processor, coupled to the input and the output of the sensor cable, for generating a signal in response to the terminal voltage produced from the at least one secondary cable, wherein the processor is coupled to the reflectometer for locating the disturbance along the integrated sensor cable based on a timing differential of the reflected signal relative to the injected signal.

In a fifth aspect, the present invention provides an integrated sensor cable for use in an intrusion detection system having a processing unit, the sensor cable having an input and an output, both the input and the output of the sensor cable for coupling to the processing unit for locating a disturbance along the sensor cable and for generating a signal in response to the disturbance, the integrated sensor cable comprising a coaxial cable having a first electrically conductive cable member, a second electrically conductive cable member, and an electrical insulating member disposed between the first cable member and the second cable member, the first cable member being loosely disposed in the coaxial cable and thus freely movable relative to the insulating member, to provide an impedance change in response to the disturbance in an active state, and the coaxial cable capable of producing an terminal voltage in response to the disturbance, in a passive state.

In a sixth aspect, the present invention provides an integrated sensor cable for use in an intrusion detection system having a processing unit, the sensor cable having an input and an output, both the input and the output of the sensor cable for coupling to the processing unit for locating a disturbance along the sensor cable and for generating a signal in response to the disturbance, the integrated sensor cable comprising a primary cable having a first electrically conductive cable member, a second electrically conductive cable member, and an electrical insulating member disposed between the first cable member and the second cable member, the first cable member being loosely disposed in the coaxial cable and thus freely movable relative to the insulating member, to provide an impedance change in response to the disturbance and at least one secondary cable, for passive disturbance sensing capable of producing a passive response to the disturbance.

BRIEF DESCRIPTION OF THE DRAWINGS

The present invention will now be described with reference to the drawings, in which.

DETAILED DESCRIPTION OF THE INVENTION

Figure 1:
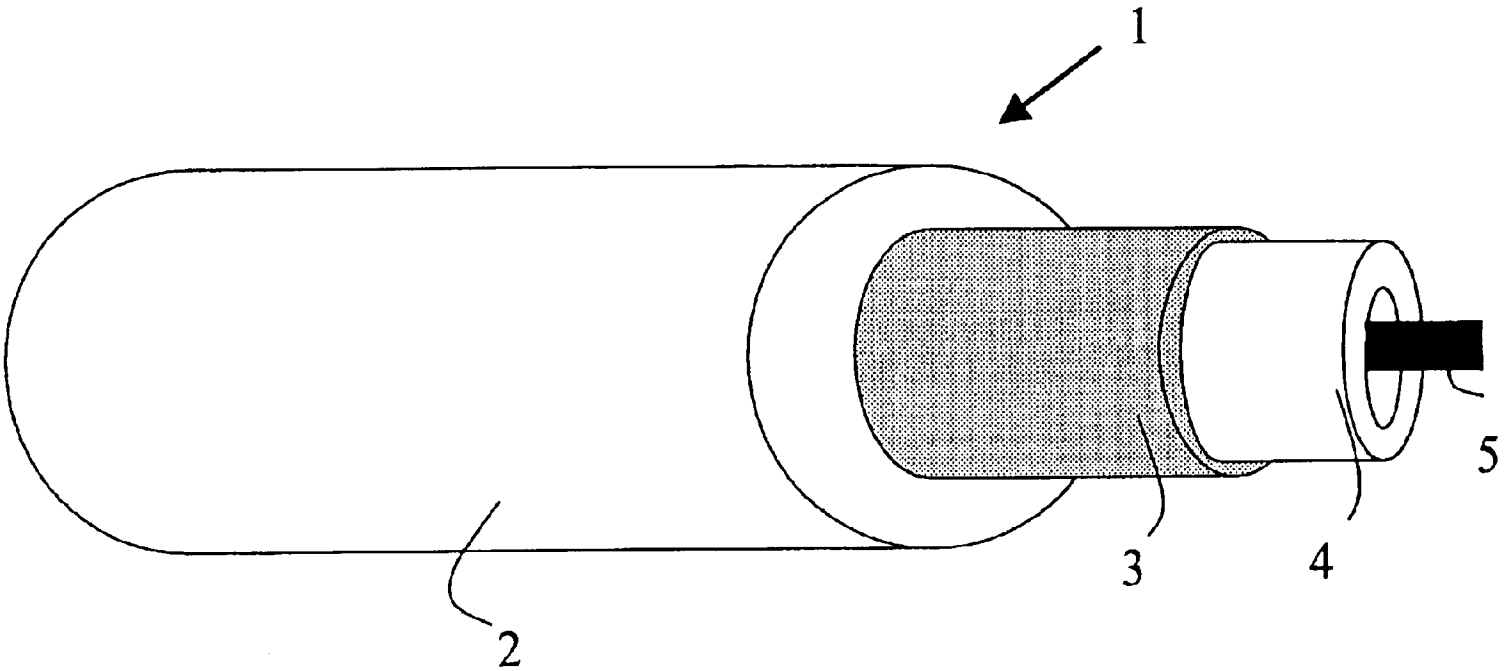
FIG. 1 Prior Art
FIG. 1 is an illustration of a triboelectric sensor cable known in the prior art and which can be optimized for dual use according to the present invention.

The invention will be described for the purposes of illustration only in connection with certain embodiments. However, it is to be understood that other objects and advantages of the present invention will be made apparent by the following description of the drawings according to the present invention. While a preferred embodiment is disclosed, this is not intended to be limiting. Rather, the general principles set forth herein are considered to be merely illustrative of the scope of the present invention and it is to be further understood that numerous changes may be made without straying from the scope of the present invention.

For the purposes of this document, the "active ranging" cable system is one where a signal is injected (transmitted) into the cable, and a response signal, either unmodified or modified by an intruder, is sensed by a receiver and analyzed by a processor to determine range or location of the intrusion, similar to radar. For example, the injected signal to a loosely disposed conductor cable could be a pulse, and the reflected signal from an intruder altering the impedance of the cable is captured at the same cable end and analyzed; e.g., time relative to the input pulse is used to obtain location, amplitude or frequency to classify the intruder as a valid target.

Also for the purposes of this document, in a "passive" cable system, there is no signal injected by a transmitter, rather it is created on the sensor cable itself by the disturbance, such as in triboelectric, piezoelectric and electret cables. The signal is received and analyzed as a generally continuous time response waveform of some amplitude and frequency—there is no timing data relative to an injected signal to provide location. For example with the Intelli-FLEX™ system the sensor cable is constructed with suitable materials having triboelectric properties, to produce a small voltage between inner and outer conductors in response to local cable flexing, from the presence of the intruder.

It is also understood that the classification of "passive, or passive sensing, or passive disturbance sensing" systems includes those cable systems that require some excitation signal applied to the sensing cable to provide the passive sensing signal to analyze. These systems as such do not generate a voltage signal on their own, for example magnetic or fiber optic cables.

For example with the IntelliFIBER™ system, a signal input is a continuous optical signal applied at one end of the fiber cable. The system receives a signal at the other end of the fiber cable which has its polarization altered by the intruder's presence. The optical output signal is converted to a voltage response very similar to the passive sensed output of the Intelli-FLEX sensor. This system does not provide location data, as there is no timing element nor reflection data provided with sensing at the opposite cable end. Accordingly, the present invention may be incorporated into such a system, as a passive sensing system with a converted voltage output relative to the disturbance.

Also for purposes of this document there are some conductor cable sensors that are generally coaxial but may have additional conductors within their structure, such as magnetic sensing cables, and may be incorporated in such a system.

Referring now to FIG. 1, a loose-wire-in-tube triboelectric transducer cable 1 of the prior art, which may be optimized for dual use as a sensor cable for ranging purposes, is shown. The transducer cable 1 is constructed with a protective cable jacket 2, a conductive shield 3, an insulating dielectric plastic outer tube 4, and an inner sense conductor 5. The outer tube 4 loosely encloses the sense conductor 5. The outer tube 4 has an inner diameter larger than the outer diameter of the sense conductor 5. The cable jacket 2 may be made of polyester elastomer, or any suitable material. The coaxial cable outer conductor protective shield 3 may be made of tinned braided copper strands for electrical isolation purposes, or such strands in combination with a metallic foil layer or any other suitable electrical conductor. The sense conductor 5 may be any suitable conductor, such as tin-plated copper strands. For the passive use of a triboelectric cable, the dielectric outer tube 4 and inner sense conductor 5 are typically selected for their triboelectric properties and processing compatibility, for example the dielectric may be Fluorinatedethylenepropylene (FEP). In triboelectric operation, when the transducer cable 1 is disturbed locally, the sense conductor moves within the outer tube 4 which causes a small, terminal voltage to be produced between the conductors, which is sensed at the end of the cable. For the active use of ranging, the cable is optimized for the movement of the loosely disposed conductor in the cable so that there is adequate change in the capacitance, and hence impedance at the point where there is a disturbance.

An alternative construction is possible where the outer conductive shield member 3 could be the loose conductive cable member relative to the insulating outer tube 4, whereas the inner sense conductor 5 is not free to move relative to the outer tube 4. Alternatively, it is possible that the insulating tube 4 be "floating", loosely disposed between both conductive members 3, 5.

Figure 3:
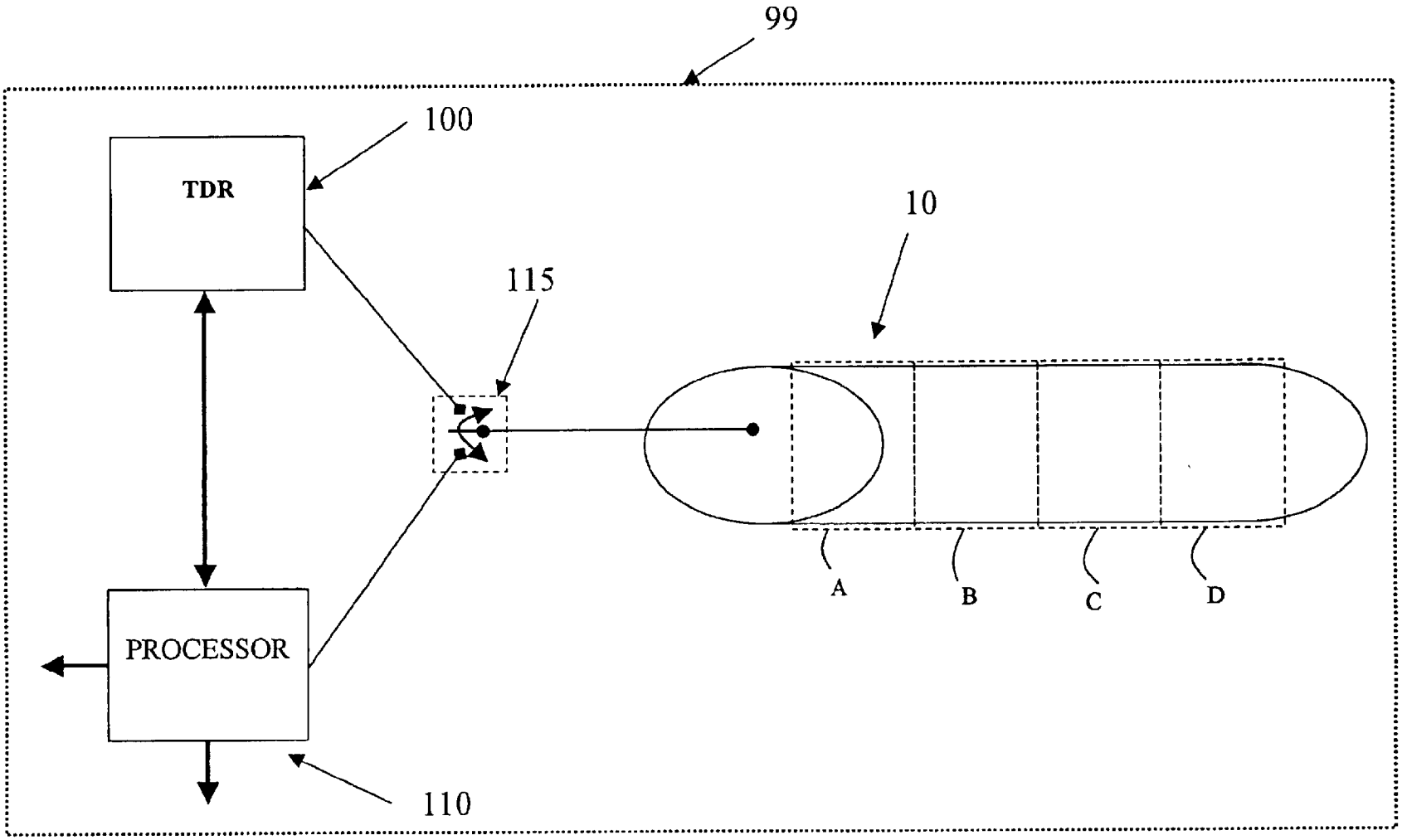
FIG. 3 is a block diagram of a sensor cable system including an integrated sensor cable of the present invention for both a passive and active cable detection of a disturbance along the length of the sensor cable according to a second embodiment.

A reflectometer may be coupled to the cable 1, such as the Time Domain Reflectometer (TDR) 100 shown pictorially in a further FIG. 3, which can measure the change in impedance as a function of time as it is directly proportional to the distance along the cable 1.

To further explain, a TDR is utilized to interrogate the cable by propagating a pulse down the cable. When the pulse reaches an impedance change along the cable, a portion or all of the pulse energy is reflected back dependent on the size of the impedance change from the cable's characteristic impedance. The TDR measures the time it takes to travel down the cable to the disturbance where the impedance change occurs, and back along the cable. The TDR then forwards the reflected signal information to a processor or to a display. This implementation of the TDR, coupled to a sensor cable, is in an "active" state to provide an "active ranging" cable system. Alternatively, a cable may be coupled to a processor in a "passive" state is to provide a "passive" cable system. In a "passive" state, the processor would measure a voltage change, with appropriate additional circuitry in some cases, as a time response function generated on the cable in response to a disturbance. In an embodiment of the present invention, both the passive cable system and the active cable system may be integrated to provide both the passive and the active states of cable sensing.

Figure 2:
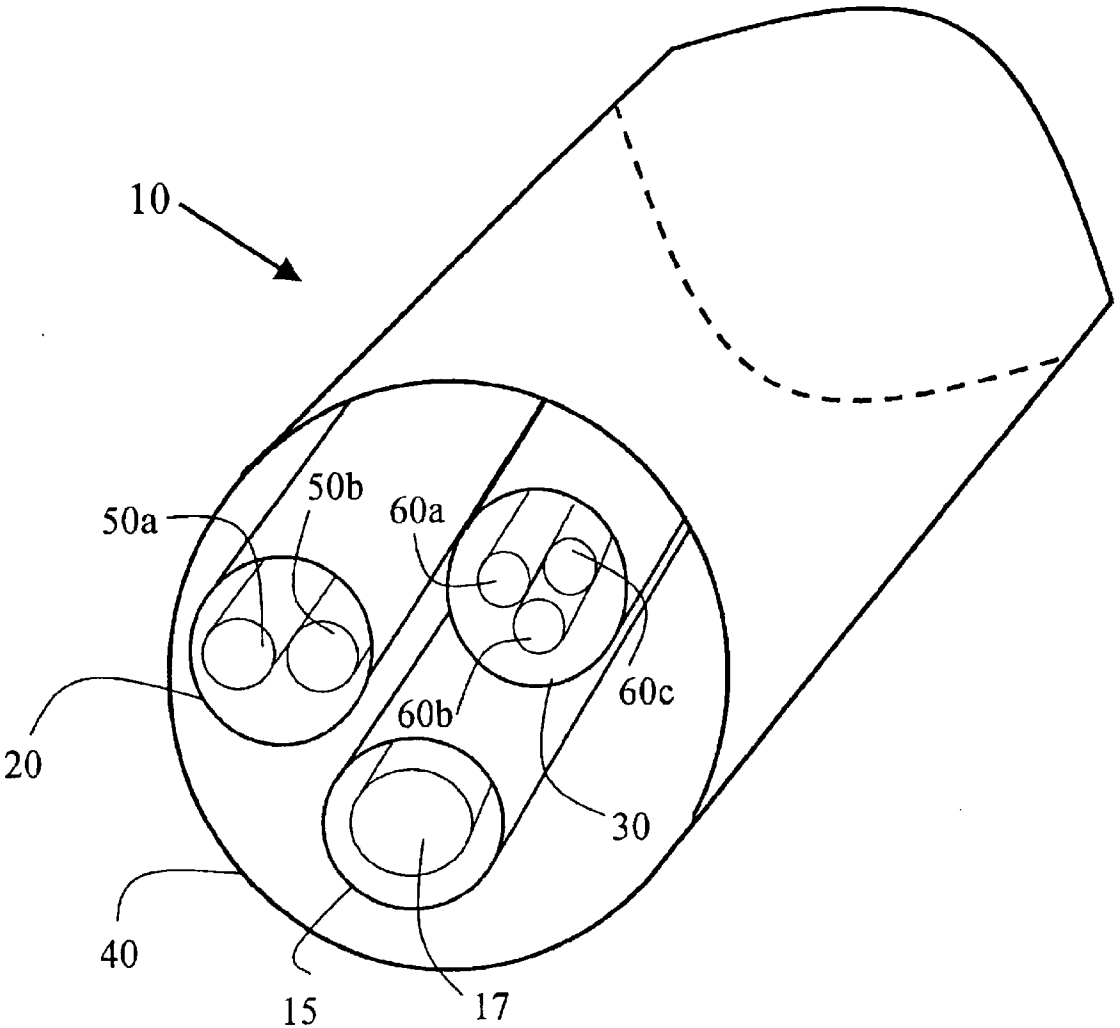
FIG. 2 is an illustration of an integrated sensor cable configuration according to a first embodiment of the present invention.

In FIG. 2, a sectional view of an integrated security sensor cable 10 according to the present invention is illustrated. The security sensor cable 10 consists of a first jacket 15, a second jacket 20, a third jacket 30, and an overjacket 40 in which the first jacket 15, the second jacket 20, and the third jacket 30 are positioned collinearly, or coaxially. The first jacket 15 contains a ranging sensor cable 17, such as the sensor cable 1 of FIG. 1 where its cable jacket 2 forms the first jacket 15 of the ranging sensor cable 17. While the ranging sensor cable 17 is shown encased in the first jacket 15, it does not require an outer jacket for integration into the sensor cable 10. The ranging sensor cable 17 is a conductor cable generally having two cable conductor members, and an electrical insulating member between, where at least one of the two cable conductor members is freely movable relative to the insulating member, and where one cable member might fully enclose the other. As explained with reference to FIG. 1, either, if not both, of the two cable members may be freely movable.

It should be mentioned that the integrated security sensor cable 10 may contain a single coaxial cable such as loose-wire-in-tube triboelectric transducer cable 1, described with reference to FIG. 1. For the purposes of this document, the integrated security sensor cable is also termed a "functionally" integrated sensor cable where the cable includes at least one sensing cable optimized for dual use, or at least two sensing cables where one cable has a designated active use and another cable has a designated passive use.

The second jacket 20 contains two fiber optic cables 50*a*, 50*b*. While only two fiber optic cables 50*a*, 50*b* are shown, the skilled artisan will understand that the fiber optic cables may be in the form of cabling bundles with multiple individual fibers in the second jacket 20, or fiber optic cable ribbon, or the like. At least one of the two fiber optic cables 50*a*, 50*b* is an optical sensing fiber. According to the present invention, an optical sensing fiber is utilized to generate a response to a sensed disturbance in proximity of the sensor cable 10. It should be noted that the optical sensing fiber or adjacent fibers may be further utilized in transmitting secure data signals, i.e. both optical sensing signals and secure data signals can be multiplexed along a single optical sensing fiber. The third jacket 30 contains power conductor cables 60*a*, 60*b*, and an auxiliary data cable 60*c* such as coaxial cables, twisted pairs, . . . etc. The overjacket 40 defines a secure area having a diameter that is wide enough to contain the first jacket 15, second jacket 20 and the third jacket 30.

It should be mentioned that the ranging sensor cable 17 may also be coupled with any other linear sensing cable that does not directly provide an easily measured impedance change and likely requires at least two cables in total, one ranging sensor cable, such as a transducer cable, and one non-ranging sensor cable, i.e., piezoelectric, electret, magnetic, fiber optic etc. While the use of such cables is likely more costly and adds complexity in processing signals, these cables would be suitable for the purposes of the present invention. In a further embodiment shown FIG. 4, the integrated sensor cable 130 shown includes both a ranging sensor cable 140 and a non-ranging sensor cable 150.

The utilization of a bundled jacket structure, as in FIG. 2, provides for security sensor systems that do not require separate installation of ranging and non-ranging sensors, sensor power, and data communication cables. The cable material chosen may further increase the advantages of utilizing an overjacket 40 according to the present invention. If the sensor system were intended for underground applications, the overjacket 40 may be a waterproof layer. Materials such as polyethylene, polyvinyl chloride or stainless steel, or any similarly suitable waterproof layer may be used in the overjacket 40. Alternatively, the overjacket 40 may be form fit around jackets 15, 20, and 30 by any method or manner such as, but not limited to, extrusion, or heat shrinking depending upon the material used, or may contain tensile or filler members such as Kevlar™ which is a polymer containing aromatic and amide molecular groups.

As the integrated security sensor cable 10 of the present invention may be buried in the ground, the sensor cable 10 may require a rodent resistant layer along the overjacket 40. It is conceivable that the same security sensor cable may be partly buried in the ground and partly running above ground on a given structure, such as, but not limited to fences, walls, or gates.

According to one embodiment of the present invention, the fiber optic cables 50*a*, 50*b*, may be standard commercial fiber optic cables selected for their detection or data communications properties. The integrated security sensor cable 10, which would include the ultraviolet resistant overjacket, may be further attached to a fence by means of ultraviolet resistant cable ties (not shown). One or more of the fiber optic cables 50*a*, 50*b* will communicate optical signal changes, based on minute flexing of it, when an attempt is made to cut, climb, or lift fence fabric for example, or more particularly to disturb the sensor cable 10. In this embodiment, the third jacket 30, of FIG. 2, may alternatively enclose solely a plurality of power conductor cables.

The combination of an "active" sensor cable, in a first jacket, and a "passive" sensor cable, in a second jacket, enables the security system to provide a dual functionality of actively ascertaining the location of the disturbance while passively sensing disturbances. As well, by further combining the second power conductor cables and auxiliary data cables, both power and data transmission are also provided along the sensor cable. The possible use of the third jacket 30, and the data cables therein, provides additional or alternative data transmission means through the sensor cable 10. As such, the sensor cable 10 may provide multiple functions if implemented in a security sensor system. For example, the data cable 60*c*may provide audio or video signals throughout a security system while the fiber optic cables 50*a*, 50*b* would transmit other data signals.

In FIG. 3, an intrusion detection system 99 of the present invention utilizes a Time Domain Reflectometer (TDR) 100, or a reflectometry unit, to inject a signal into the sensor cable 10 in order to determine the location of the intrusion based on the timing of the reflection of the injected signal. The system 99 shown in FIG. 3 utilizes a switch means 115 for a discrete time switching approach where the TDR 100 inputs a voltage (pulse) down the sensor cable 10 and receives a reflection, whereas a processor 110 is passively sensing a voltage output in a time sequence. The sensor cable 10, being of both a loosely disposed conductor and triboelectric construction, will cause both a triboelectric charge transfer, and an impedance change, when an intrusion occurs. The triboelectric charge change is sensed by a system processor 110 whereas the impedance change is sensed by the TDR 100. The time differential relative to the reflection from the impedance change provides the range to the disturbance along the sensor cable 10.

Further in FIG. 3, the intrusion detection system 99 provides a dual functionality on a single coaxial cable, which forms the sensor cable 10, in that the processor 110 can passively sense a disturbance based on a voltage generated while the TDR 100 may actively sense the reflected pulse along the sensor cable 10. The triboelectric voltage generated on the sensor cable 10 in response to the disturbance can be measured and processed, similar to a conventional passive sensor system. Both the active state and passive state of cable sensing can also be executed in a chosen alternating time sequence by processor control of switch means 115.

In this implementation of the present invention, a further consideration is thresholding and zoning for determining the presence and location of an intruder. For example, it may be useful to electronically define zones or range bins, that correspond to features of the perimeter where the cable is deployed, such as corners of buildings or gates, in order to activate video assessment or response forces. These zones, or a subset of these zones, may have respective detection thresholds set by a calibration procedure, for example, setting a low threshold in an area where the intruder detection is low (e.g., a very stiff fence), or high for a fence section that provides a large intrusion response.

As shown in FIG. 3, if processing is based on the time response, the sensor cable 10 may be divided electronically into zones or range bins. For example the sensor cable 10 is divided into four zones A, B, C, and D. Each zone is assigned a particular range such that the reflectometer attributes the location of the disturbance based on the zone in which the disturbance is detected.

The sensor cable 10 may be coupled to either a time or frequency domain processor 110 in order to perform the dual functionality of detection and location within one processor having an integrated transmitter/receiver unit (not shown). Thus, the TDR 100, as a separate unit, is not required in the intrusion detection system 99 but rather its function integrated into the processor 110. The TDR function generally encompasses a method of creating a pulse, injecting it into the cable, and receiving and processing the time-response reflected signal from a cable to monitor signal changes as a function of distance. Thus, the processor 110 could utilize, for example, a directional coupler for separating the transmitted and reflected signals, or a reflection bridge, dependent on the type of signals injected and the application.

Techniques such as range bins with individual intrusion thresholds set on each bin to improve the signal to noise ratio (SNR) could also be utilized by the processor 110. As described earlier, the processor 110 could implement various ranging approaches. In one such implementation, a "wideband" cable input may be applied to the sensor cable, and a frequency domain processing applied to the return signal in order to determine disturbance location.

Figure 4:
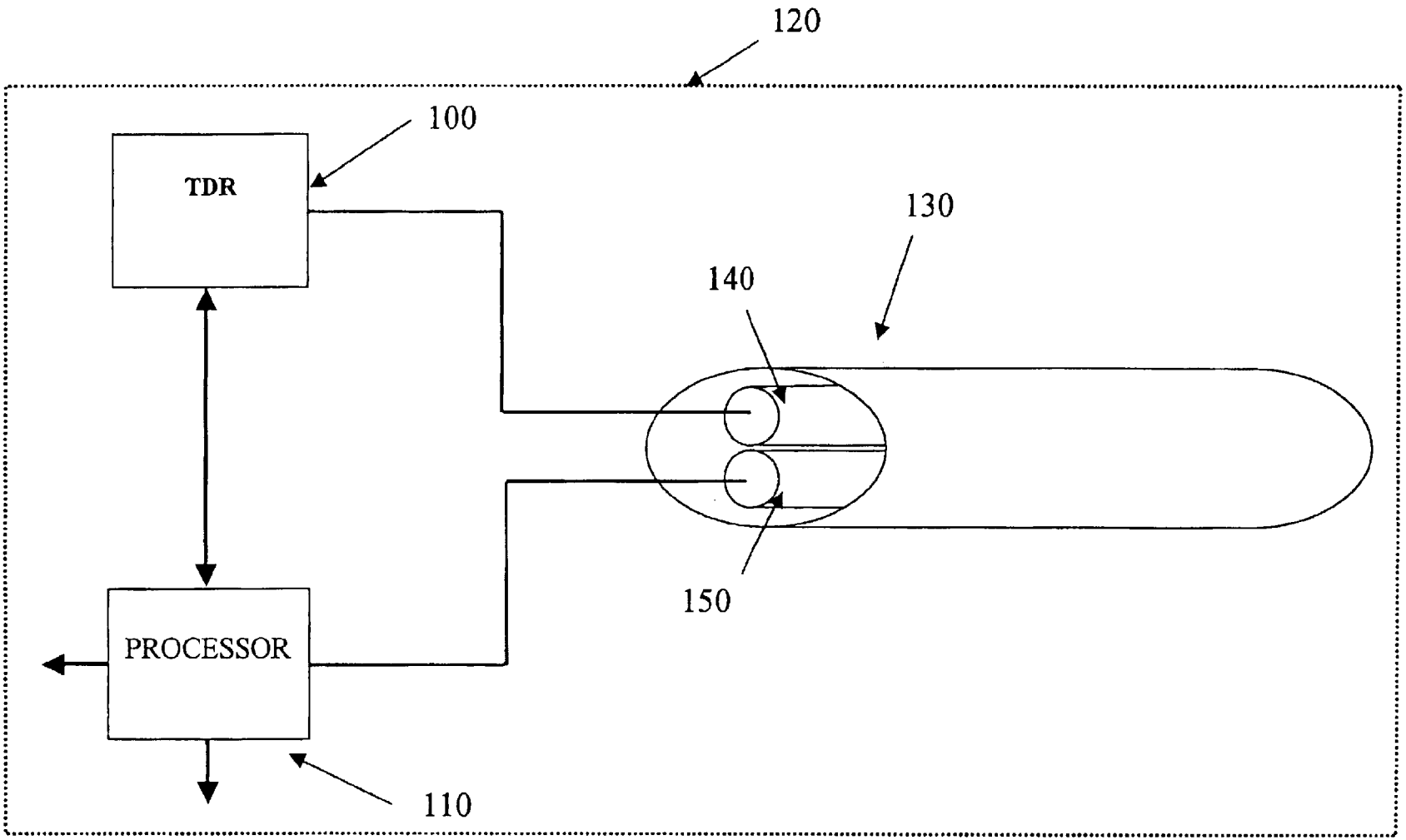
FIG. 4 is a block diagram of a sensor cable system including an integrated sensor cable having two separate cable for both the passive and active cable detection of a disturbance by the sensor cable system according to a third embodiment of the present invention.

In FIG. 4, a block diagram of an intrusion detection system 120, similar to that of FIG. 3, is illustrated. The intrusion detection system 120 sensor includes an integrated sensor cable 130 that has two separate and parallel coaxial cables 140 and 150, whereas the sensor cable 10 of FIG. 3 has a single coaxial cable constructed for dual use. Each coaxial cable 140, 150 is illustrated as being encased in separate jackets, however they may be encased in a single jacket. According to the present invention, the first coaxial cable 140 is coupled to the TDR 100 and utilized in an active ranging function. The second coaxial cable 150 is coupled to the processor 110 and utilized in a passive disturbance sensing function. For example, the first coaxial cable 140 is a coaxial cable having a loosely disposed center conductor for single use ranging, and the second coaxial cable 150 is a transducer cable using a phenomenology such as piezoelectric, magnetic, triboelectric, electret, or the like. Other suitable material for passive disturbance sensing may be utilized. For example, fiber optic cable, which is not coaxial in construction nor produce a terminal voltage in response to a disturbance, can be utilized for passive disturbance sensing and included in the integrated sensor cable 130. It is understood that fiber optic cable, as well as magnetic cable, have different characteristics and construction as compared to the triboelectric cable. In FIG. 4, the coaxial cable 140 is visually identical to the triboelectric transducer cable 1 of FIG. 1, but would not require the more costly materials like FEP for triboelectric sensing. In this case, the TDR and processor functions would not be required to be time switched to share the same cable, as in FIG. 3, as there are individual inputs to the two coaxial cables 140,150.

Figure 5:
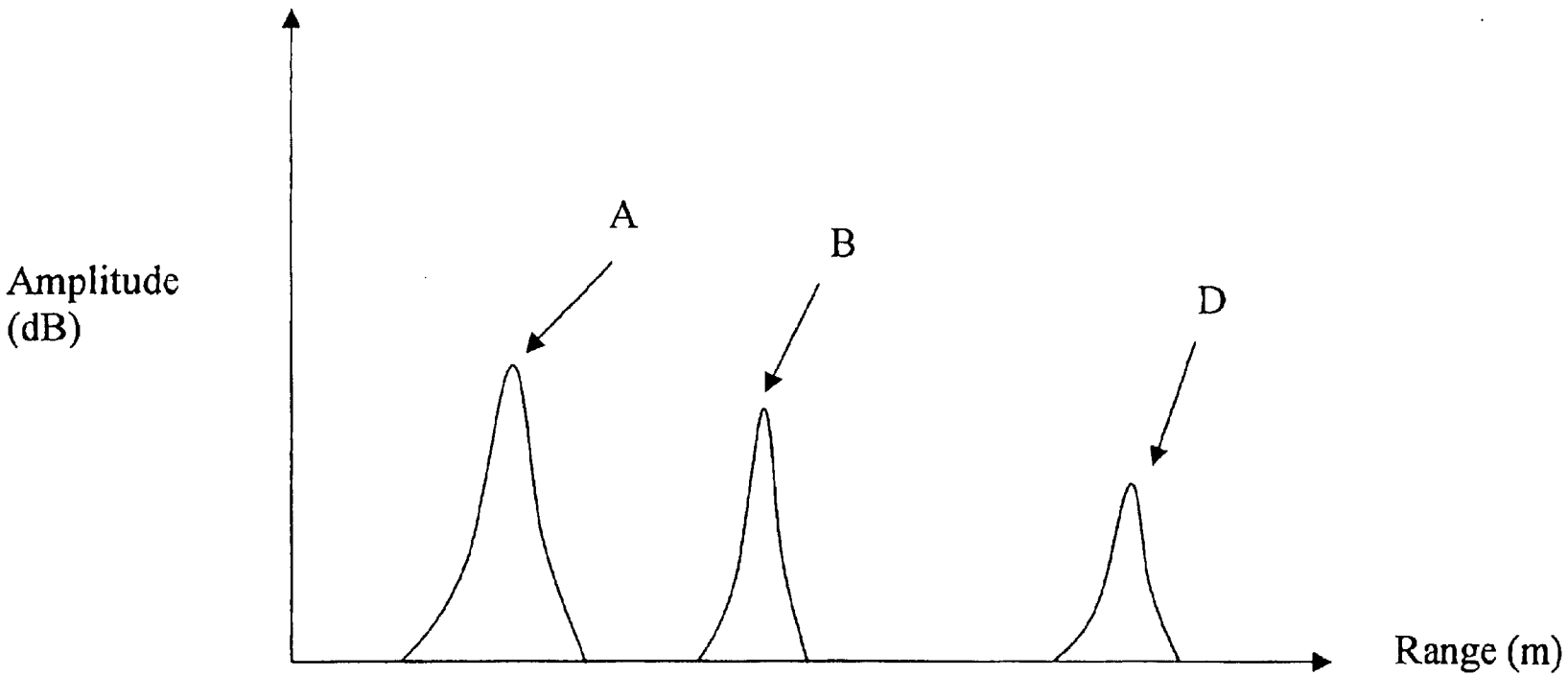
FIG. 5 is a graph representing the response of each impact of three test impacts within each defined zone along the sensor cable of FIG. 3.

Referring now to FIG. 5, in experimental testing, a TDR Cable Tester, the Tektronix™ 1503, by Tektronix, Inc. of Beaverton, Oreg., USA, was connected to an Intelli-FLEX™ cable mounted on a chain-link fence of the present invention. Using a setting of 10 nanosecond impulses and 20 dB return loss, the fence was struck in three zones A, B, and D with a wrench to simulate an intrusion and the display response noted. FIG. 5 illustrates a graph representing the response of each impact within the struck zones A, B, and D along the sensor cable 10 of FIG. 3. At each impact, a 1–2dB signal change is shown. Attenuation down towards the end of the cable, in zone D, was noted, as the TDR unit utilized does not compensate for sensitivity relative to time.

In one specific embodiment of the present invention, the integrated sensor cable may be utilized in conjunction with the proprietary Intelli-FLEX™ system, which uniquely uses triboelectric cables. Such a system currently senses via the triboelectric charge produced by flexing or motion of the cable to determine the presence of an intrusion, and additionally produces a continuous signal output over a frequency band that includes an audio band, to "listen in" on the intruder response. By utilizing a time-domain reflectometer component, as described earlier—coupling to either end of the sensor cable 10—the impedance change, along a triboelectric cable, may also be sensed to determine the precise location of a disturbance.

The Intelli-FLEX™ system may be further implemented in existing systems to provide location with only an additional hardware component. For example the TDR function could be implemented as a daughtercard, in accordance with the present invention or could alternatively be replaced with a frequency domain approach, and potentially provide further SNR improvements. In addition, a Sensitivity Time Controller (STC) may be utilized in conjunction with the TDR to improve the SNR by varying gain corresponding to the received signal timing.

According to the present invention, there are various time and frequency domain methods that exist and could be applied for determining range. These typically are described in radar texts, once a method of producing a reflection corresponding to the target location is devised related to the transmit and receive elements, being antenna, leaky cables, or in this case shielded coaxial cables. Similarly, parameters of these can be optimized for the application, for example the pulse duration can be shortened to improve target location accuracy with a time-domain reflectometry approach, or the bandwidth of a frequency modulated injected signal increased in a frequency domain approach.

In another embodiment, a dual integrated sensor cable may also form part or be deployed in conjunction with of the sensor cable utilized in the IntelliFIBER™ system of Senstar-Stellar Corporation or other manufacturers such as those produced by Fiber SenSys, Inc, of Beaverton, Oreg., US or by Future Fibre Technologies Pty. Ltd., Rowville, Victoria, Australia. The integrated sensor cable may be positioned within a secure cable jacket to provide enhanced intrusion detection including intruder range.

The present invention may be further implemented as an integrated sensor cable system, where further power cables, and copper or fiber-optic communication cables are also included in the integrated sensor cable. It is also understood that other sensing phenomenologies, including magnetic, piezoelectric, electret, and the like, may be utilized without straying from the intended scope of the present invention.

Dependent on the two cable phenomenologies, different inputs or outputs of the cable may be used for different functions or at different times. For example with the Intelli-FLEX™ application the reflectometer function may be performed at one end of the cable in a time sequence between which the same or other end of the cable is passively sensed for the triboelectric effect. Ideally, the cable end not being sensed is terminated appropriately, e.g., with its characteristic impedance for the TDR function, or a high impedance for the triboelectric effect. Similarly, the Intelli-FIBER™ injects an optical signal in one end of a fiber and receives on the opposite end.

It should be understood that the preferred embodiments mentioned here are merely illustrative of the present invention. Numerous variations in design and use of the present invention may be contemplated in view of the following claims without straying from the intended scope and field of the invention herein disclosed.

Having thus described the invention, what is claimed as new and secured by Letters Patent is:

1. An intrusion detection system comprising:

a coaxial cable having a first electrically conductive cable member, a second electrically conductive cable member, and an electrical insulating member disposed between the first conductive cable member and the second conductive cable member, the first cable member being loosely disposed in the coaxial cable and thus freely movable relative to the insulating member, to provide an impedance change in response to a disturbance, and the coaxial cable capable of producing a terminal voltage in response to the disturbance; and a processing unit, operatively coupled to the coaxial cable, for propagating an injected signal into the coaxial cable and receiving a reflected signal altered by the impedance change along the coaxial cable, and locating the disturbance based on a timing differential between the reflected signal relative and the injected signal, in an active state, and for generating a signal in response to the terminal voltage produced from the coaxial cable, in a passive state.

2. The intrusion detection system as in claim 1, further including switching means coupled to the processing unit for alternating in a time sequence between the passive state and the active state.

3. The intrusion detection system as in claim 1, wherein the coaxial cable further includes at least one further conductor.

4. The intrusion detection system as in claim 2, wherein the coaxial cable further includes at least one further conductor.

5. The intrusion detection system as in claim 1, wherein the coaxial cable uses the triboelectric effect to generate the terminal voltage in the passive state.

6. An intrusion detection system comprising:

an integrated sensor cable having an input and an output, the sensor cable having:

a primary cable having a first electrically conductive cable member, a second electrically conductive cable member, and an electrical insulating member disposed between the first cable member and the second cable member, the first cable member being loosely disposed in the primary cable and thus freely movable relative to the insulating member, to provide an impedance change in response to a disturbance; and at least one secondary sensor cable capable of producing a response to the disturbance; and a processing unit, operatively coupled to the input side and the output side of the integrated sensor cable, for propagating an injected signal and receiving a reflected signal altered by the impedance change along the primary cable, and locating the disturbance based on a timing differential between the reflected signal and the injected signal, in an active state, and for generating a signal based on the response from the at least one secondary sensor cable, in a passive state;

wherein the primary cable propagates therealong an injected signal from the processing unit.

7. The intrusion detection system as in claim 6, wherein the integrated sensor cable is encased within an overjacket.

8. The intrusion detection system as in claim 6, wherein the primary cable is encased in a first cable jacket, and wherein the at least one secondary cable is encased in a second cable jacket, such that the first cable jacket and the second cable jacket are disposed to form the integrated sensor cable.

9. The intrusion detection system as in claim 6, wherein the primary cable further includes at least one further conductor.

10. The integrated sensor cable as in claim 6, wherein the at least one secondary sensor cable, for passive disturbance sensing, includes at least one cable chosen from the group consisting of: triboelectric transducer cable, piezoelectric cable, magnetic cable, and electret cable.

11. The integrated sensor cable as in claim 6, wherein the at least one secondary sensor cable, for passive disturbance sensing, includes at least one fiber optic cable.

12. The integrated sensor cable as in claim 6, wherein the integrated sensor cable further includes at least one power cable.

13. The integrated sensor cable as in claim 6, wherein the integrated sensor cable further includes at least one data cable.

14. An intrusion detection system comprising:

an integrated sensor cable having an input and an output, the sensor cable having:

a coaxial cable having a first electrically conductive cable member, a second electrically conductive cable member, and an electrical insulating member disposed between the first cable member and the second cable member, the first cable member being loosely disposed in the coaxial cable and thus freely movable relative to the insulating member, to provide an impedance change in response to a disturbance, and capable of producing a terminal voltage in response to the disturbance;

a reflectometer for propagating an injected signal and receiving a reflected signal altered by the impedance change along the coaxial cable;

a processor for generating a signal in response to the terminal voltage produced from the coaxial cable; and switching means being coupled to the processor and the reflectometer for alternating in a time sequence between the processor and the reflectometer;

wherein the switching means is coupled to the input and the output of the integrated sensor cable, and wherein the processor is coupled to the reflectometer for locating the disturbance along the integrated sensor cable based on a timing differential of the reflected signal relative to the injected signal.

15. An intrusion detection system comprising:

an integrated sensor cable having an input and an output, the sensor cable having:

a primary cable having a first electrically conductive cable member, a second electrically conductive cable member, and an electrical insulating member disposed between the first cable member and the second cable member, the first cable member being loosely disposed in the primary cable and thus freely movable relative to the insulating member, to provide an impedance change in response to a disturbance; and at least one secondary cable capable of producing a terminal voltage in response to the disturbance;

a reflectometer, coupled to the input of the integrated sensor cable, for propagating an injected signal and receiving a reflected signal altered by the impedance change along the primary cable; and a processor, coupled to the input and the output of the sensor cable, for generating a signal in response to the terminal voltage produced from the at least on secondary cable;

wherein the processor is coupled to the reflectometer for locating the disturbance along the integrated sensor cable based on a timing differential of the reflected signal relative to the injected signal.

16. The intrusion detection system as in claim 14, wherein the injected signal is a pulsed signal.

17. The intrusion detection system as in claim 14, wherein the processor is a microprocessor based signal processor.

18. The intrusion detection system as in claim 14, wherein the processor is a time domain processor.

19. The intrusion detection system as in claim 14, wherein the processor is a frequency domain processor.

20. The intrusion detection system as in claim 15, wherein the at least one secondary sensor cable, for passive disturbance sensing, includes at least one cable chosen from the group consisting of: piezoelectric cable, magnetic cable, electret cable, and a fiber optic cable.

21. An integrated sensor cable for use in an intrusion detection system having a processing unit, the sensor cable having an input and an output, both the input and the output of the sensor cable for coupling to the processing unit for locating a disturbance along the sensor cable and for generating a signal in response to the disturbance, the integrated sensor cable comprising:

a coaxial cable having a first electrically conductive cable member, a second electrically conductive cable member, and an electrical insulating member disposed between the first cable member and the second cable member, the first cable member being loosely disposed in the coaxial cable and thus freely movable relative to the insulating member, to provide an impedance change in response to the disturbance, in an active state, and the coaxial cable capable of producing a terminal voltage in response to the disturbance, in a passive state.

22. The integrated sensor cable as in claim 21, wherein the first conductive cable member encloses the second conductive cable member.

23. The integrated sensor cable as in claim 21, wherein the second conductive cable member encloses the first conductive cable member.

24. The integrated sensor cable as in claim 21, wherein the coaxial cable further includes at least one further conductor.

25. The integrated sensor cable as in claim 21, wherein the coaxial cable uses the triboelectric effect to generate the terminal voltage in the passive state.

26. The integrated sensor cable as in claim 21, wherein the integrated sensor cable includes at least one secondary sensor cable chosen from the group consisting of: triboelectric transducer cable, piezoelectric cable, magnetic cable, electret cable, and fiber optic cable.

27. The integrated sensor cable as in claim 21, wherein the integrated sensor cable further includes at least one power cable.

28. The integrated sensor cable as in claim 21, wherein the integrated sensor cable further includes at least one data cable.

29. The integrated sensor cable as in claim 21, wherein the integrated sensor cable is encased within an overjacket.

30. The integrated sensor cable as in claim 26, wherein the coaxial cable is encased in a first cable jacket, and wherein the at least one secondary cable is encased in a second cable jacket, such that the first cable jacket and the second cable jacket are disposed to form the integrated sensor cable.

31. The integrated sensor cable as in claim 27, wherein the power cable is encased in a cable jacket.

32. An integrated sensor cable for use in an intrusion detection system having a processing unit, the sensor cable having an input and an output, both the input and the output of the sensor cable for coupling to the processing unit for locating a disturbance along the sensor cable and for generating a signal in response to the disturbance, the integrated sensor cable comprising:

a primary cable having a first electrically conductive cable member, a second electrically conductive cable member, and an electrical insulating member disposed between the first cable member and the second cable member, the first cable member being loosely disposed in the coaxial cable and thus freely movable relative to the insulating member, to provide an impedance change in response to the disturbance; and at least one secondary cable, for passive disturbance sensing capable of producing a passive response to the disturbance.

* * * * *